US006276285B1

(12) United States Patent
Ruch

(10) Patent No.: US 6,276,285 B1
(45) Date of Patent: Aug. 21, 2001

(54) BARREL CARRYING DEVICE

(76) Inventor: Wayne P. Ruch, 920 Brownsville Rd., Wernersville, PA (US) 19565

( * ) Notice: Subject to any disclaimer, the term of this patent is extended or adjusted under 35 U.S.C. 154(b) by 0 days.

(21) Appl. No.: 09/453,623

(22) Filed: Dec. 3, 1999

(51) Int. Cl.[7] ..... B65D 19/38

(52) U.S. Cl. ..... 108/57.13; 108/55.5; 206/386; 248/346.03; 248/499

(58) Field of Search ..... 248/154, 230.8, 248/346.03, 499, 500, 687, 346.02, 505, 346.04; 206/386; 108/57.13, 901, 902, 55.1, 55.5, 56.1, 56.3, 57.17, 51.11

(56) References Cited

U.S. PATENT DOCUMENTS

| | | | |
|---|---|---|---|
| Re. 25,827 | 8/1965 | Bigelow, Jr. | 206/386 |
| 2,692,064 | 10/1954 | Koester | 217/12 R |
| 2,696,360 | 12/1954 | Toffolon | 206/597 |
| 3,372,855 | 3/1968 | Smith | 229/199 |
| 3,753,407 | 8/1973 | Tilseth | 108/53.3 |
| 3,961,585 | 6/1976 | Brewer | 410/97 |
| 4,421,253 | 12/1983 | Croley | 222/105 |
| 5,323,903 | 6/1994 | Bush et al. | 206/386 |
| 5,887,529 | 3/1999 | John et al. | 108/56.1 |
| 5,931,435 | 8/1999 | Hoadley et al. | 248/346.03 |
| 5,971,336 | 10/1999 | McCraney | 248/313 |

*Primary Examiner*—Ramon O. Ramirez
*Assistant Examiner*—Jon Szumny

(57) ABSTRACT

A barrel carrying device for preventing a barrel from rolling around and damaging a vehicle. The barrel carrying device includes a rectangular frame having a pair of longitudinal members and a pair of cross members interconnecting the longitudinal members, and further includes four hook members disposed at the corners of the frame and fastening the cross members to the longitudinal members, and also includes a thin rubber material which is securely attached to the bottom side of one of the cross members to prevent the frame from sliding on a surface such as that found in a vehicle, and further includes a continuous elastic member which loops through the hook members and extends about a barrel placed on the frame to prevent the barrel from rolling about and damaging a vehicle.

14 Claims, 2 Drawing Sheets

BARREL CARRYING DEVICE

BACKGROUND OF THE INVENTION

1. Field of the Invention

The present invention relates to a barrel cradling device and more particularly pertains to a new barrel carrying device for preventing a barrel from rolling around and damaging a vehicle.

2. Description of the Prior Art

The use of a barrel cradling device is known in the prior art. More specifically, a barrel cradling device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,747,780; U.S. Pat. No. 4,971,275; U.S. Pat. No. 4,555,083; U.S. Pat. No. 4,354,599; U.S. Pat. No. 3,938,768; and U.S. Pat. No. Des. 245,929.

While these devices fulfill their respective, particular objectives and requirements, the aforementioned patents do not disclose a new barrel carrying device. The inventive device includes a rectangular frame having a pair of longitudinal members and a pair of cross members interconnecting the longitudinal members, and further includes four hook members disposed at the corners of the frame and fastening the cross members to the longitudinal members, and also includes a thin rubber material which is securely attached to the bottom side of one of the cross members to prevent the frame from sliding on a surface such as that found in a vehicle, and further includes a continuous elastic member which loops through the hook members and extends about a barrel placed on the frame to prevent the barrel from rolling about and damaging a vehicle.

In these respects, the barrel carrying device according to the present invention substantially departs from the conventional concepts and designs of the prior art, and in so doing provides an apparatus primarily developed for the purpose of preventing a barrel from rolling around and damaging a vehicle.

SUMMARY OF THE INVENTION

In view of the foregoing disadvantages inherent in the known types of a barrel cradling device now present in the prior art, the present invention provides a new barrel carrying device construction wherein the same can be utilized for preventing a barrel from rolling around and damaging a vehicle.

The general purpose of the present invention, which will be described subsequently in greater detail, is to provide a new barrel carrying device which has many of the advantages of the barrel cradling device mentioned heretofore and many novel features that result in a new barrel carrying device which is not anticipated, rendered obvious, suggested, or even implied by any of the prior art a barrel cradling device, either alone or in any combination thereof.

To attain this, the present invention generally comprises a rectangular frame having a pair of longitudinal members and a pair of cross members interconnecting the longitudinal members, and further includes four hook members disposed at the corners of the frame and fastening the cross members to the longitudinal members, and also includes a thin rubber material which is securely attached to the bottom side of one of the cross members to prevent the frame from sliding on a surface such as that found in a vehicle, and further includes a continuous elastic member which loops through the hook members and extends about a barrel placed on the frame to prevent the barrel from rolling about and damaging a vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new barrel carrying device which has many of the advantages of the barrel cradling device mentioned heretofore and many novel features that result in a new barrel carrying device which is not anticipated, rendered obvious, suggested, or even implied by any of the prior art a barrel cradling device, either alone or in any combination thereof.

It is another object of the present invention to provide a new barrel carrying device which may be easily and efficiently manufactured and marketed.

It is a further object of the present invention to provide a new barrel carrying device which is of a durable and reliable construction.

An even further object of the present invention is to provide a new barrel carrying device which is susceptible of a low cost of manufacture with regard to both materials and labor, and which accordingly is then susceptible of low prices of sale to the consuming public, thereby making such barrel carrying device economically available to the buying public.

Still yet another object of the present invention is to provide a new barrel carrying device which provides in the apparatuses and methods of the prior art some of the advantages thereof, while simultaneously overcoming some of the disadvantages normally associated therewith.

Still another object of the present invention is to provide a new barrel carrying device for preventing a barrel from rolling around and damaging a vehicle.

Yet another object of the present invention is to provide a new barrel carrying device which includes a rectangular frame having a pair of longitudinal members and a pair of cross members interconnecting the longitudinal members, and further includes four hook members disposed at the corners of the frame and fastening the cross members to the longitudinal members, and also includes a thin rubber material which is securely attached to the bottom side of one of the cross members to prevent the frame from sliding on a surface such as that found in a vehicle, and further includes a continuous elastic member which loops through the hook members and extends about a barrel placed on the frame to prevent the barrel from rolling about and damaging a vehicle.

Still yet another object of the present invention is to provide a new barrel carrying device that protects against the possibility of bodily harm to passenger in the vehicle.

Even still another object of the present invention is to provide a new barrel carrying device that is easy and very convenient to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
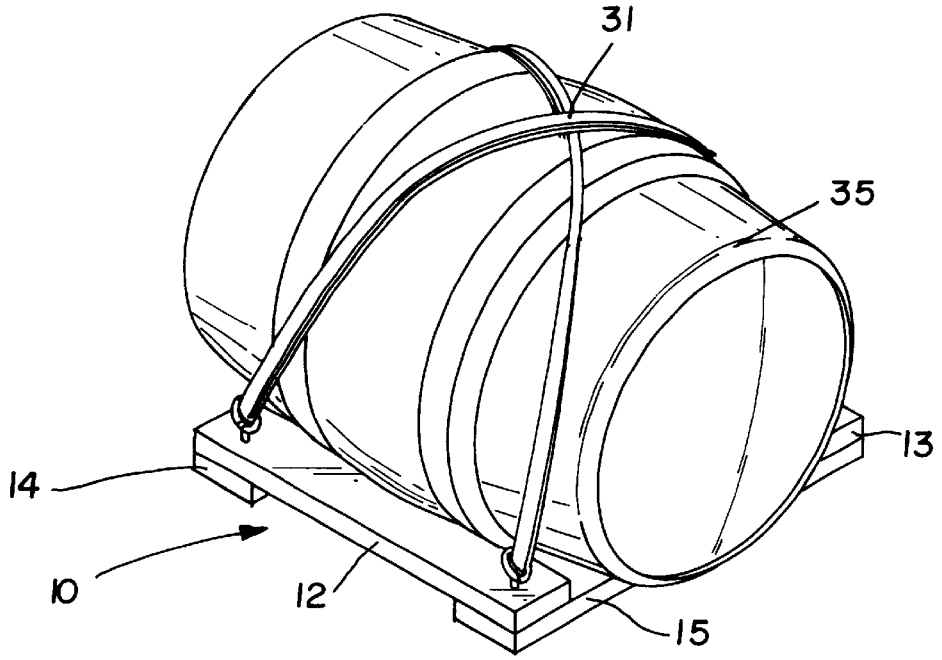
FIG. 1 is a perspective view of a new barrel carrying device according to the present invention as being used.
Figure 2:
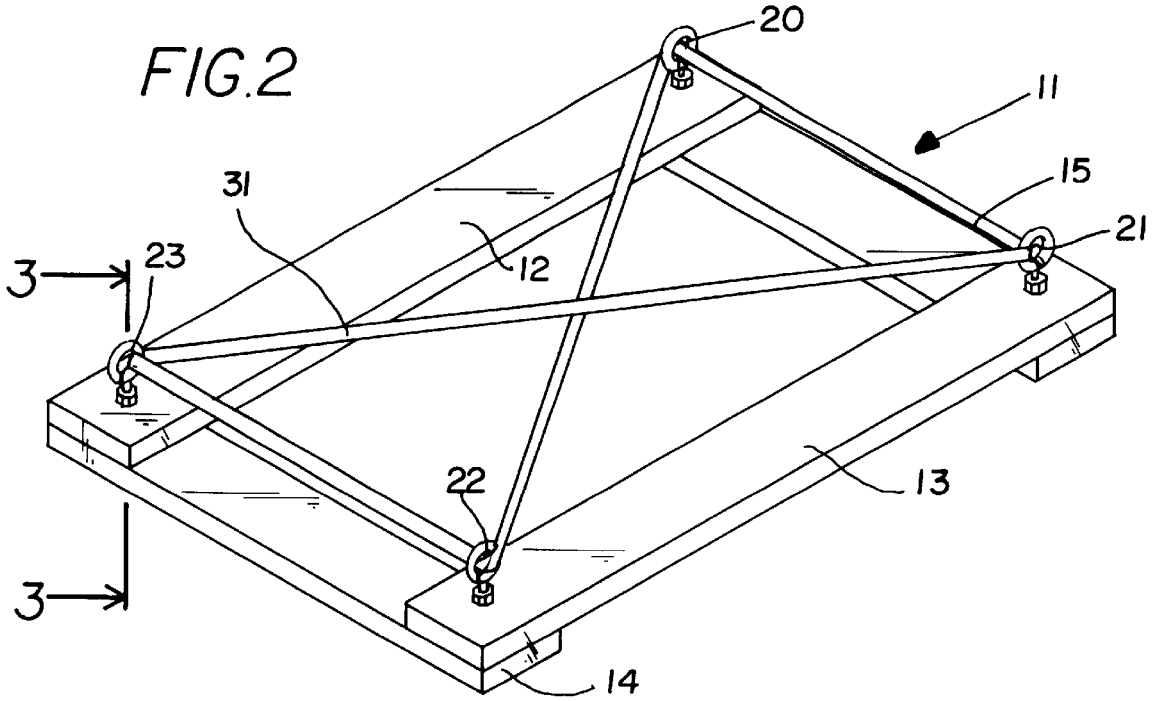
FIG. 2 is perspective view of the present invention.
Figure 3:
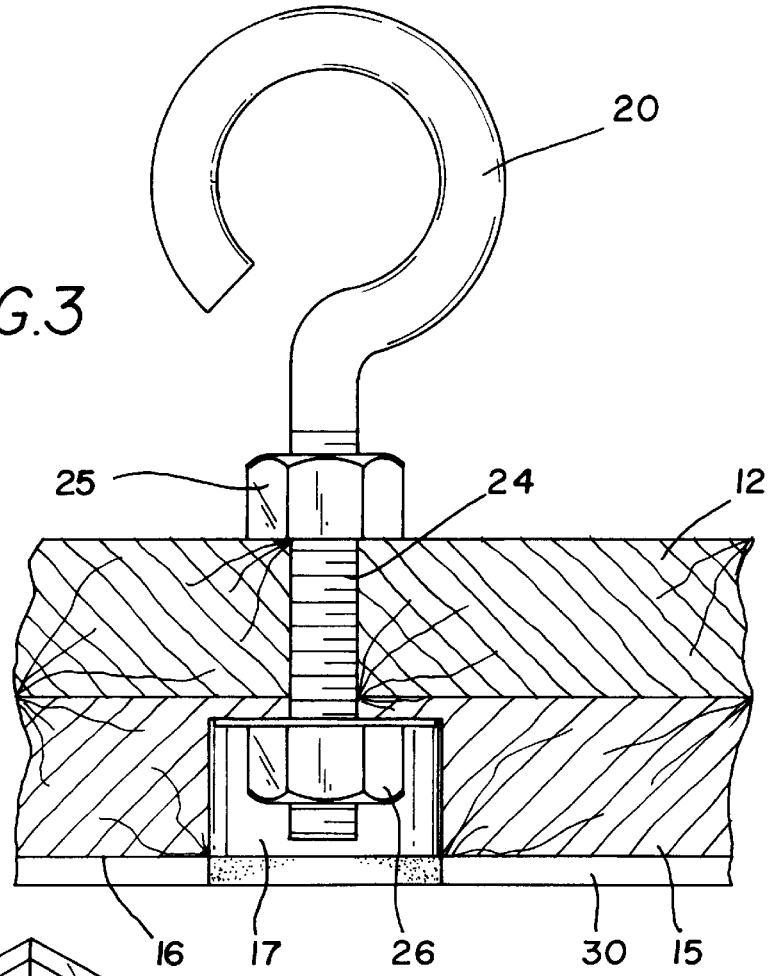
FIG. 3 is a detailed cross-sectional view of a hook member of the present invention.
Figure 4:
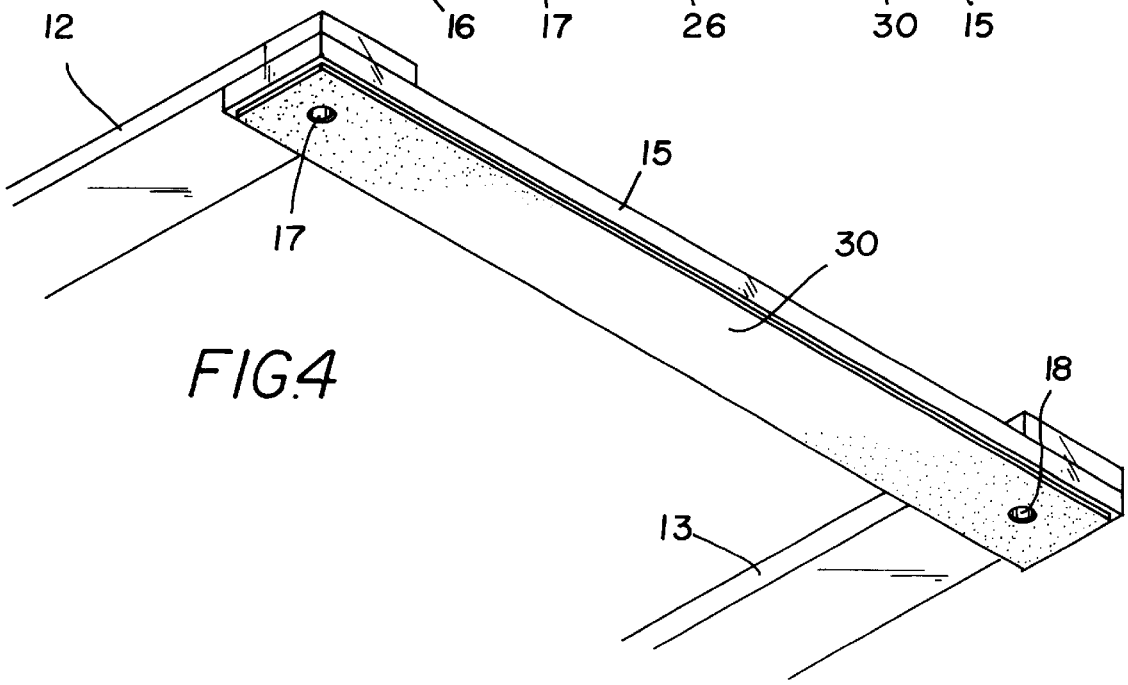
FIG. 4 is a detailed perspective view of the bottom side of a cross member of the present invention.

With reference now to the drawings, and in particular to FIGS. 1 through 4 thereof, a new barrel carrying device embodying the principles and concepts of the present invention and generally designated by the reference numeral 10 will be described.

As best illustrated in FIGS. 1 through 4, the barrel carrying device 10 generally comprises a frame 11 having a pair of longitudinal members 12,13 and a pair of cross members 14,15 interconnecting and securely attached to the longitudinal members 12,13. Each of the longitudinal 11,12 and cross 14,15 members is a thin, flat elongate piece of rigid material such as wood. The longitudinal members 12,13 and the cross members 14,15 are arranged so as to form a rectangular structure which is approximately 18 inches long , 18 inches wide and 5 inches high.

A plurality of hook members 20–23 are spaced apart and securely attached to the frame 11. Each of the hook members 20–23 is disposed at a respective corner of the rectangular structure. Each of the hook members 20–23 securely fastens a respective longitudinal member 12,13 to a respective cross member 14,15. Each of the hook members 20–23 includes an elongate threaded portion 24 which extends through a respective longitudinal member 12,13 and a respective cross member 14,15 and further includes fastening members 25,26 threaded upon the elongate threaded portion 24 for fastening a respective cross member 14,15 to a respective longitudinal member 12,13. Each of the cross members 14,15 has a bottom side and a pair of slots 17,18 extending in the bottom side 16 near ends of the cross member 14,15 with the slots 17,18 being adapted to receive the nuts 25,26 and the elongate threaded portions 24.

A non-slip means 30 is securely attached to a bottom of the frame 11 to substantially prevent the barrel carrying device 10 from sliding on a surface. The non-slip means 30 includes a thin piece of material securely attached to the bottom side 16 of one of the cross member 15. The non-slip means 30 is dimensioned to cover an entire bottom side 16 of the cross member 15. The thin piece of material is made essentially of rubber.

An elastic member 31 is connectable to the hook members 20–23 for securing a barrel 35 to the frame 11. The elastic member 31 is capable of extending about a barrel 35 supported upon the frame 11.

In use, the user places a barrel 35 upon the rectangular frame 11 and loops the elastic member 31 through the hook members 20–23 and over the barrel 35 to secure the barrel 35 to the frame 11, and then places the barrel carrying device 10 upon the desired surface such as the floor of a vehicle with the non-slip means 30 being disposed on the surface which will prevent the barrel carrying device 10 from sliding about.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A barrel carrying device comprising:

a frame having a pair of longitudinal members and a pair of cross members interconnecting and securely attached to said longitudinal members;

a plurality of hook members spaced apart and securely attached to said frame;

a non-slip means securely attached to a bottom of said frame to substantially prevent said barrel carrying device from sliding on a surface;

at least one elastic member connectable to said hook members for securing a barrel to said frame;

wherein each of said longitudinal and cross members is a thin, flat elongate piece of rigid material;

wherein said longitudinal and cross members are arranged so as to form a rectangular structure;

wherein each of said hook members is disposed at a respective corner of said rectangular structure;

wherein each of said hook members securely fastens a respective said longitudinal member to a respective said cross member; and wherein each of said hook members includes an elongate threaded portion which extends through a respective said longitudinal member and a respective said cross member.

2. The barrel carrying device as described in claim 1, wherein each of said cross members has a bottom side and a pair of slots extending in said bottom side near ends of each of said cross members.

3. The barrel carrying device as described in claim 2, wherein said non-slip means includes at least one thin piece of material securely attached to said bottom side of at least one of said cross members.

4. the barrel carrying device as described in claim 3, wherein said non-slip means is dimensioned to cover an entire said bottom side of one of said cross members.

5. the barrel carrying device as described in claim 3, wherein said at least one thin piece of material is made essentially of rubber.

6. A barrel carrying device comprising:

a frame having a pair of longitudinal members and a pair of cross members interconnecting and securely attached to said longitudinal members, each of said longitudinal and said cross members being a thin, flat elongate piece of rigid material, said longitudinal and said cross members being arranged so as to form a rectangular structure which is approximately 18 inches long, 18 inches wide and 5 inches high;

a plurality of hook members spaced apart and securely attached to said frame, each of said hook members being disposed at a respective corner of said rectangular structure, each of said hook members securely fastening a respective said longitudinal member to a respective said cross member, each of said hook members including an elongate threaded portion which extends through a respective said longitudinal member and a respective said cross member and further including fastening members threaded upon said elongate threaded portion for fastening a respective said cross member to a respective said longitudinal member, each of said cross members having a bottom side and a pair of slots extending in said bottom side near ends of said cross member, said slots being adapted to receive said nuts and said elongate threaded portions;

a non-slip means securely attached to a bottom of said frame to substantially prevent said barrel carrying device from sliding on a surface, said non-slip means including at least one thin piece of material securely attached to said bottom side of at least one said cross member, said non-slip means being dimensioned to cover an entire said bottom side of said cross member, said at least one thin piece of material being made essentially of rubber; and at least one elastic member connectable to said hook members for securing a barrel to said frame, said at least one elastic member capable of extending about a barrel supported upon said frame.

7. A barrel carrying device comprising:

a frame having a pair of longitudinal members and a pair of cross members interconnecting and securely attached to said longitudinal members;

a plurality of hook members spaced apart and securely attached to said frame;

a non-slip means securely attached to a bottom of said frame to substantially prevent said barrel carrying device from sliding on a surface; and at least one elastic member connectable to said hook members for securing a barrel to said frame;

wherein each of said hook members fastens a respective said longitudinal member to a respective said cross member; and wherein each of said hook members includes an elongate threaded portion which extends through a respective said longitudinal member and a respective said cross member.

8. The barrel carrying device as described in claim 7, therein each of said longitudinal and cross members is a thin, flat elongate piece of rigid material.

9. The barrel carrying device as described in claim 7, wherein said longitudinal and cross members are arranged so as to form a rectangular structure.

10. The barrel carrying device as described in claim 7, wherein each of said hook members is disposed at a respective corner of said rectangular structure.

11. The barrel carrying device as described in claim 7, wherein each of said cross members has a bottom side and a pair of slots extending in said bottom side near ends of each of said cross members.

12. The barrel carrying device as described in claim 11, wherein said non-slip means includes at least one thin piece of material securely attached to said bottom side of at least one of said cross members.

13. The barrel carrying device as described in claim 12, wherein said non-slip means is dimensioned to cover an entire said bottom side of one of said cross members.

14. The barrel carrying device as described in claim 12, wherein said at least one thin piece of material is made essentially of rubber.

* * * * *